US007325257B2

(12) United States Patent
Kolar et al.

(10) Patent No.: US 7,325,257 B2
(45) Date of Patent: Feb. 5, 2008

(54) CONTROL SYSTEM FOR PUMP OPERATED PLUMBING FIXTURES

(75) Inventors: Anton J. Kolar, Sheboygan, WI (US); Jeffrey J. Mueller, Manitowoc, WI (US); Peter Denzin, Glenbeulah, WI (US); Robert Byron Freville, Sheboygan Falls, WI (US)

(73) Assignee: Kohler Co., Kohler, WI (US)

( * ) Notice: Subject to any disclaimer, the term of this patent is extended or adjusted under 35 U.S.C. 154(b) by 419 days.

(21) Appl. No.: 11/001,210

(22) Filed: Dec. 1, 2004

(65) Prior Publication Data

US 2006/0112478 A1 Jun. 1, 2006

(51) Int. Cl.
*E03D 1/00* (2006.01)

(52) U.S. Cl. ..... 4/300

(58) Field of Classification Search ..... 4/300
See application file for complete search history.

(56) References Cited

U.S. PATENT DOCUMENTS 4,258,444 A 3/1981 Orszullok
5,542,132 A 8/1996 Jaeckels et al.
5,608,923 A 3/1997 Jaeckels et al.
5,731,758 A 3/1998 Suttlemyre et al.
6,502,251 B1 * 1/2003 Teshima et al. ..... 4/300
6,934,977 B1 8/2005 Quintana et al.

FOREIGN PATENT DOCUMENTS

JP 60-169696 * 2/1984
MX PA03010014 5/2004

* cited by examiner

*Primary Examiner*—Charles E. Phillips
(74) *Attorney, Agent, or Firm*—George E. Haas; Quarles & Brady

(57) ABSTRACT

A plumbing fixture includes a receptacle for receiving waste, a tank for storing water, and an electrically operated pump that conveys water from the tank into the receptacle to flush the waste through a drain. The duration that the pump in operated to flush the waste is altered in response to variation of the electrical voltage supplied to the plumbing fixture. The pump is operated to decrease the amount of water in the tank when that amount is sensed to be excessive. Further operation of the pump is inhibited for a given interval to avoid overheating when the pump has been operating too frequently. The pump is cycled on and off in predefined patterns to indicate different malfunctions to a user.

22 Claims, 5 Drawing Sheets

TEST ROUTINE

CONTROL SYSTEM FOR PUMP OPERATED PLUMBING FIXTURES

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to pump operated, water saving plumbing fixtures, such as toilets and urinals, and more particularly to controlling operation of the pump in such plumbing fixtures.

2. Description of the Related Art

Historically, toilets have a reservoir above the level of a toilet bowl so that, upon activation of the flush valve, water is fed by gravity from the reservoir into the toilet bowl. In the past typically three or more gallons of water was required for flushing the toilet. In recent years, the efficiency of such gravity fed toilets has been improved to the extent that in many cases 1.6 gallons of water is sufficient to remove waste from the bowl. However, where especially large amounts of feces are present, double flushing often was needed to remove the waste completely.

A solution to the necessity to double flush a toilet while still using a reduced quantity of water is to pressurize the flush water entering the toilet bowl. U.S. Pat. No. 5,542,132 describes a toilet in which a pump draws water from a reservoir and feeds the water under pressure to the bowl. To achieve optimal water conservation the pump should supply just enough water to completely cleanse the bowl. However, manufacturing tolerances and altered alignment of parts can affect the water flow and thus adversely affect the flushing ability. Therefore a need exists to adjust operation of the pump for maximum efficiency with a given toilet.

In addition, many pump style toilet have the reservoir located beneath the bowl for compactness as gravity flow no longer dictates the reservoir location. However, if this type of toilet becomes plugged, there is a possibility that an excessively high level of soiled water in the bowl may enter the rim outlets thereby contaminating the reservoir. At the completion of a flush, water in the conduit leading to the bowl rim flows back downward into the reservoir drawing air into the conduit. Upon the next flush that air is forced through the rim outlets, which produces an objectionable hissing sound, as well as delaying delivery of water into the bowl.

Thus a need exists for an improved pump operated plumbing fixture.

SUMMARY OF THE INVENTION

A plumbing fixture for receiving flushable waste comprises a receptacle for receiving the waste, a tank for storing a volume of water, and an electrically operated pump having an inlet in communication with the interior of the tank and having a pump outlet coupled to the receptacle. A sensor produces a level signal when the water in the tank reaches an abnormally high level. An input device is operable by a user to produce a flush signal. A controller is connected to the sensor, the input device and the pump. The controller responds to the level signal from the sensor by operating the pump to deliver water from the tank to the receptacle thereby preventing an excessive amount of water in the tank. In response to the flush signal, the controller operates the pump for a predefined interval to deliver water from the tank to the receptacle.

In a preferred embodiment of the plumbing fixture, the predefined interval is altered in response to variation of electrical voltage supplied to power the toilet. Altering of the predefined interval, maintains pumping a relatively constant amount of water each time the waste is flushed from the receptacle.

Another aspect of the present plumbing fixture involves inhibiting repeated operation of the pump in rapid succession which could result in the pump overheating or allowing the pump to be actuated with an insufficient quantity of water in the tank. Thus pump operation subsequent activation of the pump is inhibited for a given period of time. Preferably that given period is increased the more frequently that the pump operates.

A further aspect of the present plumbing fixture utilizes an electrically operated valve in series with a convention flow valve which combined control the flow of water from a source into the tank. When the level sensor detects an abnormally large amount of water in the tank, the electrically operated valve is closed to prevent the tank from overflowing.

In a preferred embodiment, the plumbing fixture cycles the pump on and off in various patterns to provide indications a different malfunctions to the user.

DETAILED DESCRIPTION OF THE INVENTION

Although the present invention is being described in the context controlling the operation of a toilet, the inventive concepts can be applied to other types of plumbing fixtures in which waste is removed by water forced from reservoir by a pump. For example, the present invention could be used with a urinal.

Figure 1:
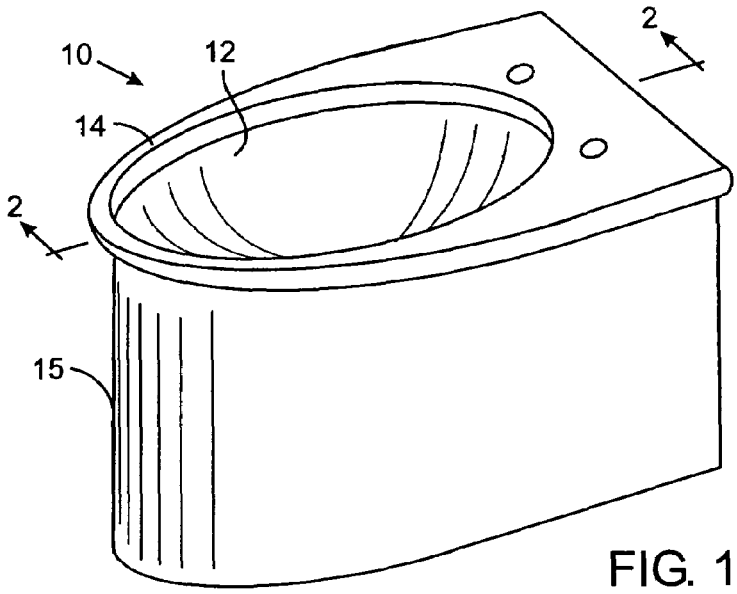
FIG. 1 is an isometric view of a toilet that incorporates the present invention.

With initial reference to FIG. 1, a toilet 10 includes a receptacle 12 in the form of a bowl with a hollow rim 14 having outlet openings extending downward into the bowl. A skirt 15 extends around and beneath the receptacle 12 providing an enclosure that houses a pump/tank assembly 16 that comprises an open top tank 17, an inlet valve assembly 20, and a flush pump 22. The inlet valve assembly 20 controls the flow of water into the tank 17 from a supply pipe 18 of the plumbing system in a building. As will be described, the inlet valve assembly 20 includes an electrically operated valve and a conventional float valve connected in series to control the flow of water into the tank 17.

The sump-type flush pump 22 is located within the tank 17. The flush pump 22 is driven by a motor with electric power being supplied by a connection 24 to the electrical wiring of the building in which the toilet is used. Any one of a variety of commerically available pumps may be used in the toilet 10. Water enters the flush pump 22 via the inlets 26 and exits through an outlet pipe 28. The pump outlet pipe 28 also is connected by a hose 34 to a backflow check valve 36 so as to provide a path to an inlet 38 under the receptacle 12. Water that is delivered to the receptacle inlet 38 is directed by passages within the receptacle 12 to outlets around the underside of the rim 14 and to a jet channel at the bottom of the receptacle.

Figure 3:
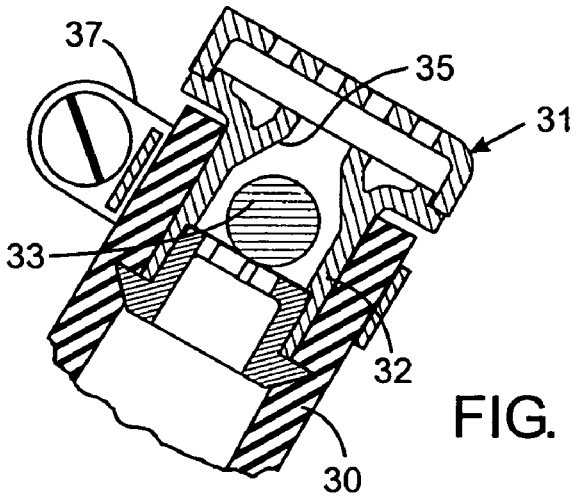
FIG. 3 is a detailed sectional view through a self priming check valve in FIG. 2.

The outlet pipe 28 has a side branch fitting to which a hose 30 is connected at one end and which has a self priming check valve 31 connected to the opposite end. Details of the priming check valve 31 are illustrated in FIG. 3. This valve comprises a tubular housing 32 that is secured in the hose 30 by a conventional hose clamp 37. The housing contains a sphere 33 that selectively engages a valve seat 35 within the tubular housing 32. With the flush pump turned off, the orientation of the priming check valve 31 enables the sphere 33 to drop away from the valve seat 35 which opens the valve and allows any air trapped in the flush pump to escape as water in the tank 17 enters the pump inlet 26. Thus the flush pump 22 is self priming.

Figure 2:
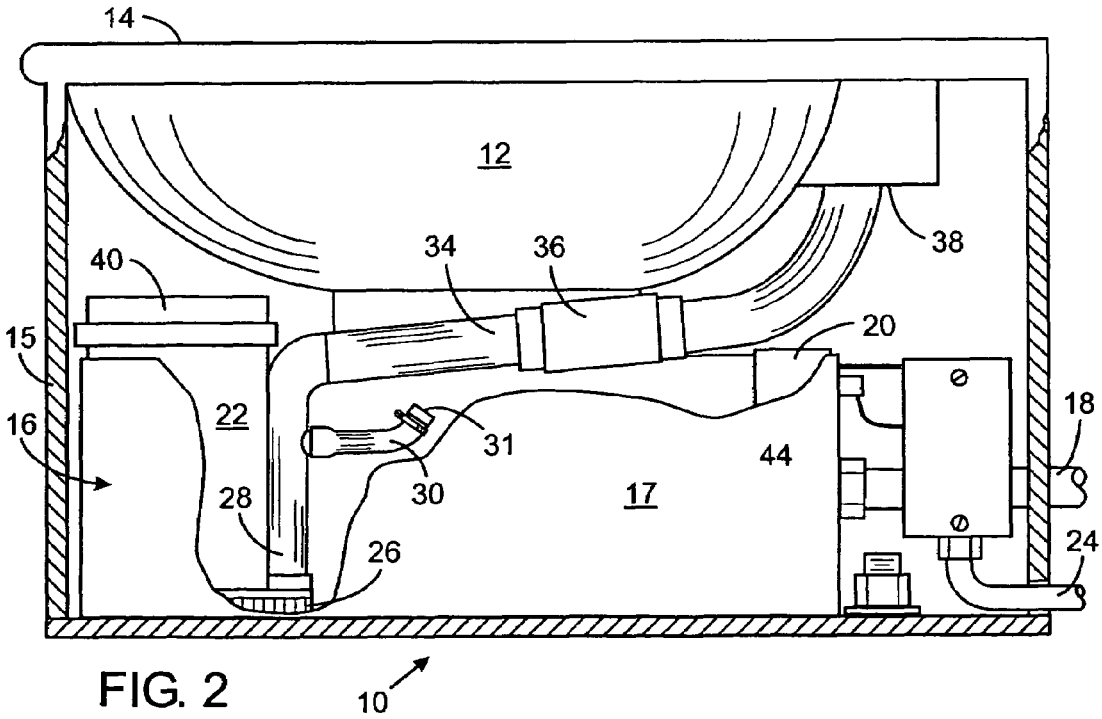
FIG. 2 is a cross sectional view along line 2-2 in FIG. 1.
Figure 4:
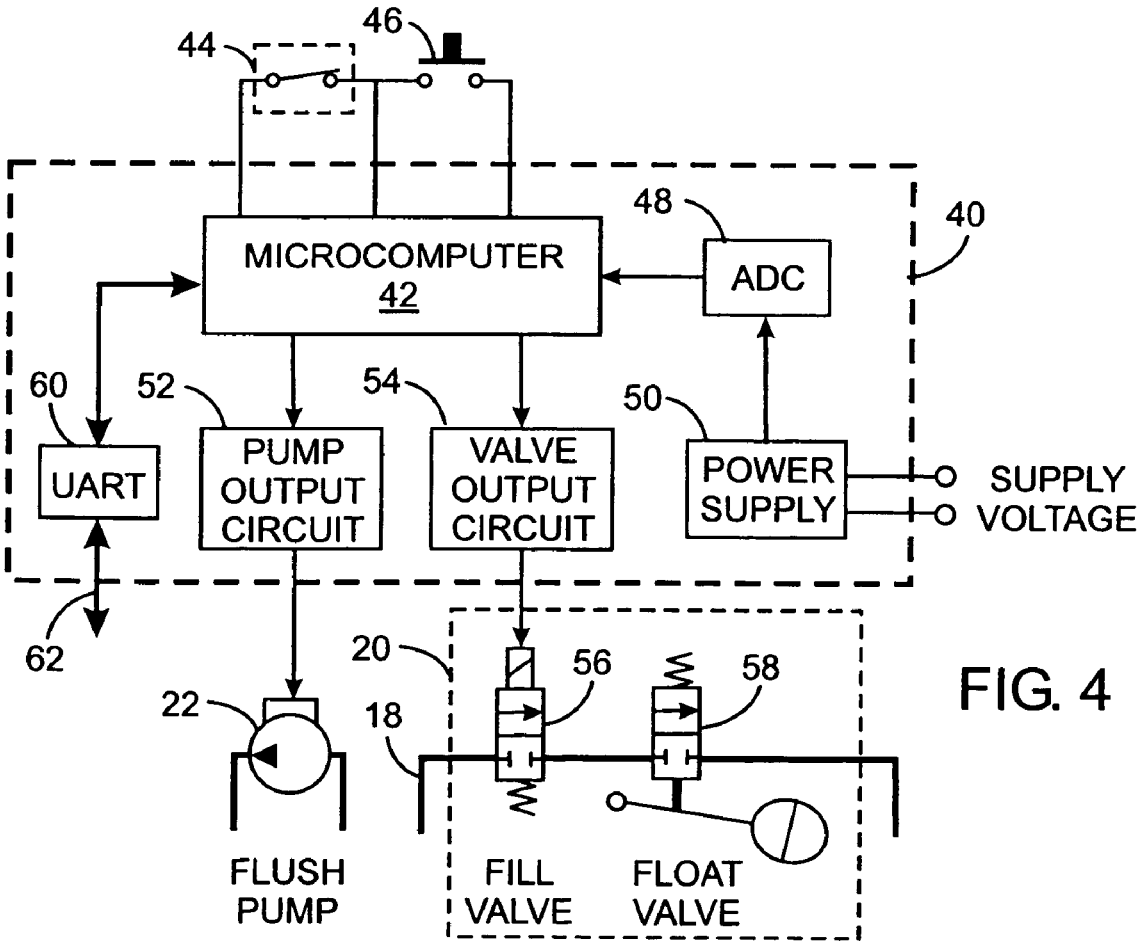
FIG. 4 is a schematic diagram of the electrical circuitry of the toilet.

The flush pump 22 and the water supply inlet valve assembly 20 are operated by an electronic controller 40 incorporated in the pump housing, the details of which are shown in FIG. 4. The electronic controller 40 includes a conventional microcomputer 42 which contains an internal memory and input/output circuits. The memory of the microcomputer 42 stores a software program which governs the operation of the toilet 10. The microcomputer 42 receives an input signal from a water level sensor 44 mounted near the top of one side of the tank 17, as shown in FIG. 2, to indicate when the water within the tank rises to an excessively high level which should not normally occur. A flush switch 46 provides an input device that is operated by the toilet user to send a signal to the microcomputer 42 when it is desired to flush the toilet 10. A digital input port of the microcomputer 42 is connected to the output of an analog-to-digital converter (ADC) 48, which receives the output voltage from the controller power supply 50 in order that the microcomputer 42 can sense the level of the supply voltage furnished to the toilet.

The electronic controller 40 also includes a pump output circuit 52 which produces an electrical current for operating the flush pump 22 in response to an output signal from the microcomputer 42. A valve output circuit 54 also receives a control signal from the microcomputer 42 and responds by operating an electrically controlled fill valve 56 within the inlet valve assembly 20 connected to the supply pipe 18. A conventional float valve 58 is coupled in series with the fill valve 56 so that both valves must be in an open state in order for water from the supply pipe 18 to flow into the tank 17. Under normal operation the conventional float valve 58 governs filling the tank with water and the water level never rises high enough to trigger the water level sensor 44. Therefore, the electrically controlled fill valve 56 is a safeguard against the open top tank 17 overflowing.

The electronic controller 40 is part of the pump/tank assembly 16 that includes the flush pump 22, the tank 17 and their related plumbing fittings. The flush pump 22 and the controller 40 are tested and configured in the factory prior to assembly with the remaining components of the toilet 10. For that purpose, the microcomputer 42 also is connected to a conventional universal asynchronous receiver/transmitter (UART) 60 which provides a bidirectional serial communication link via a serial port 62 of the controller. One pin of the serial port 62 is used to place the controller 40 in a test mode for configuring its operation.

Figure 5A:
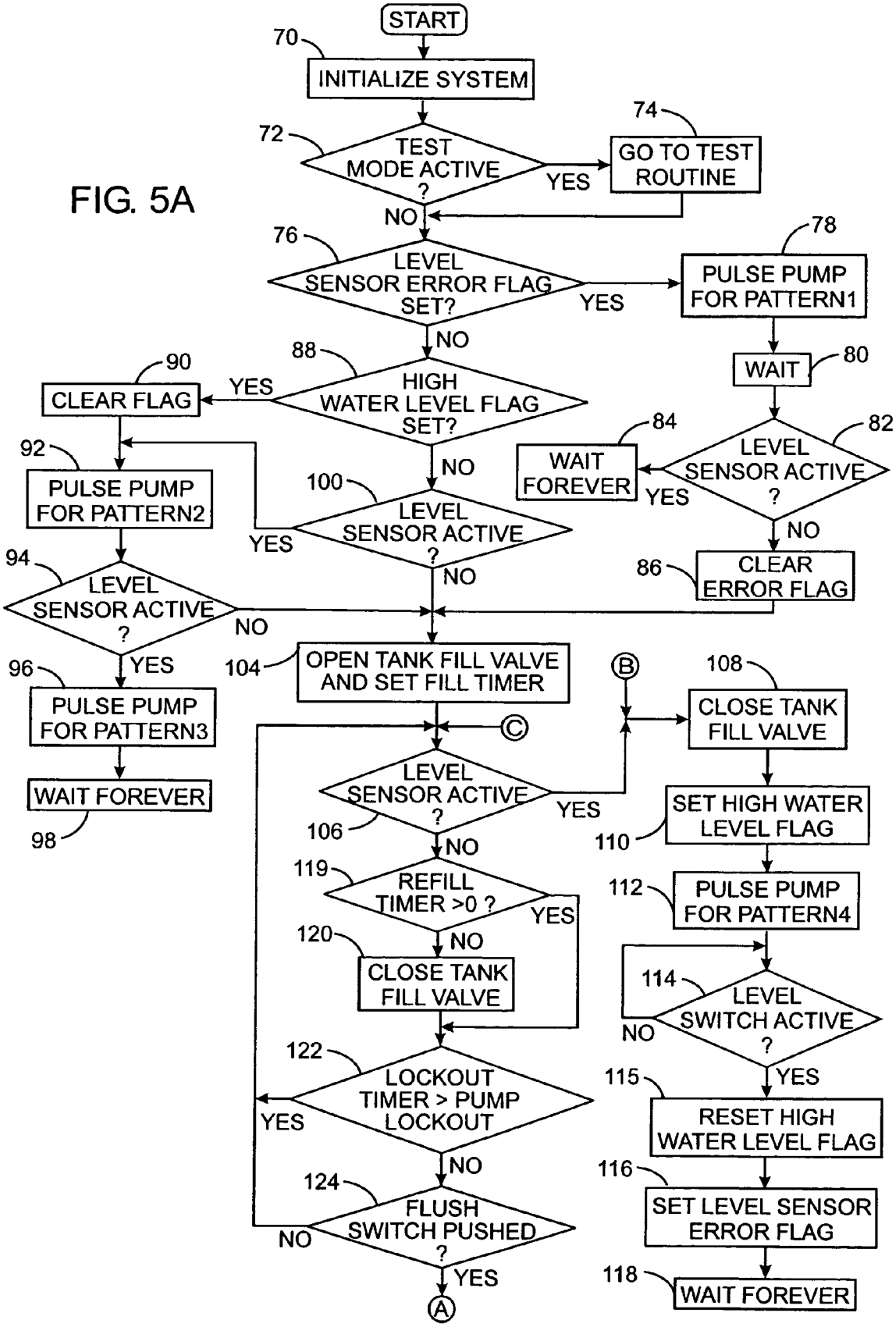
FIGS. 5A and 5B form a flowchart depicting the software program that is executed by a microcomputer in FIG. 4.
Figure 6:
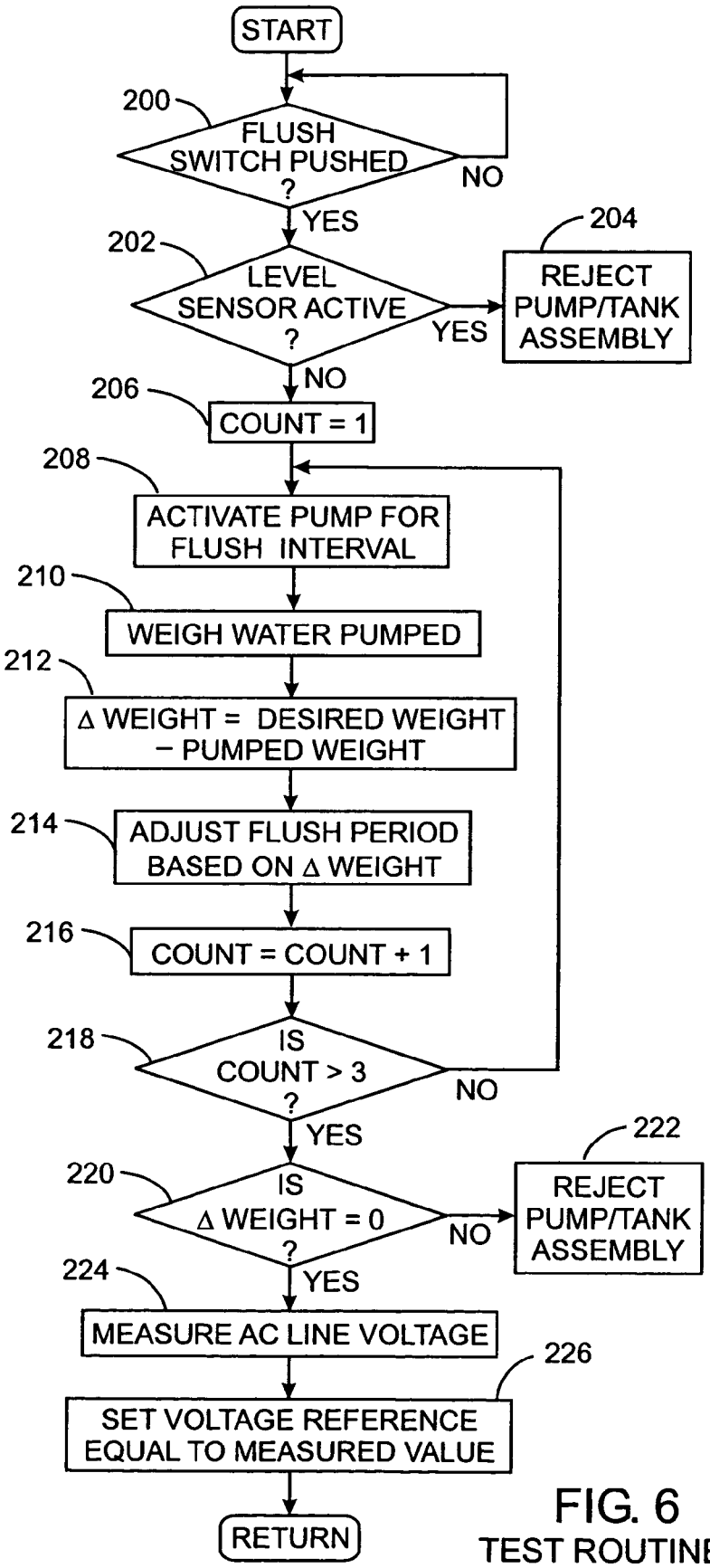
FIG. 6 is a flowchart of a test routine that is called by the software program in FIG. 5A.

The configuration is carried out at a factory test stand that includes plumbing connections and a personal computer connected to an electronic scale on which a container is placed. The personal computer is connected to the serial port 62 of the electronic controller 40 and power is applied to the combination of the pump 22 and the controller 40. Then the microcomputer 42 begins executing the stored software which is depicted in FIG. 5A. At step 70, the controller 40 is initialized by setting values of various constants and other parameters used during execution of the program. Next at step 72, a determination is made whether a pin of the serial port 62 is pulled to ground by the connection of the cable from the test stand personal computer. As this connection is present during the factory configuration, the program execution branches from step 72 to step 74 at which the software calls a test routine represented by the flowchart in FIG. 6.

The test routine commences at step 200 where a determination is made whether the flush switch 46 has been pressed. If not, the program execution continues to loop through that step. When the technician is ready to test the pump assembly operation, the flush switch 46 is depressed causing the program to advance to step 202. At this juncture, the signal from the water level sensor 44 is inspected. As noted previously, this normally closed switch opens when an excessively high level of water is present in the tank 17. If the switch is found to be open, or active, which state should not occur during the configuration process, the test routine terminates at step 204 after providing a message to the test stand computer that the pump/tank assembly 16 should be rejected.

Assuming that the water level sensor 44 is functioning properly, the test routine advances to step 206 where a loop count variable within the memory of the microcomputer 42 is set to a value of one. The test routine then enters a loop where the flush interval for operating the flush pump 22 is determined. This process commences at step 208, where the flush pump 22 is turned on for the flush interval which initially has a default value. The flush pump is activated by the microcomputer 42 sending a command signal to the pump output circuit 52 which in turn energizes the flush pump 22 for the prescribed interval which pumps water into container on the scales. After the flush pump has turned off, the container is weighed at step 210 to determine the weight of the water that was pumped from the tank. Next at step 212, the weight of the pumped water is subtracted from the desired weight which corresponds to the optimum quantity of water that should be pumped during a flush operation. This arithmetic calculation produces the difference, designated Δ weight, between the desired weight and the pumped weight of the water. If the flush pump 22 pumped the optimum quantity of water, the value of Δ weight will be zero, however, in all likelihood an adjustment of the flush interval is required. Therefore, the flush interval is adjusted based on the value of Δ weight at step 214. Specifically, a lookup table is used to convert the value of Δ weight to a time increment to be added to the present flush interval value to derive a new value for that interval. Specifically, if the value of Δ weight is positive, indicating that the pumped weight is less than the desired weight, the flush interval will be increased by adding a positive time increment. For negative values of Δ weight, as occur when the pumped weight is greater than the desired weight, the flush interval is decreased by adding a negative time increment. The newly calculated flush interval is stored within the memory of the microcomputer 43.

The test routine then advances to step 216 where the loop count is incremented by one and then tested at step 218 to determine if the new value is greater than three. The test routine makes three passes through the flush interval adjustment loop which should be sufficient, assuming that the components are operating properly, to accurately set the flush interval to a proper amount of water during each flush.

At step 220 a determination is made at the completion of the flush interval adjustment loop whether the last value of Δ weight equals zero, as should occur if the flush interval has been properly set. If that statement is not true, the test routine terminates at step 220 where the pump/tank assembly 16 is rejected.

Assuming that the configuration of the flush pump 22 passes the test at step 220 the test routine advances to step 224. At this time, the controller 40 stores a reference value corresponding to the magnitude of the line voltage supplied to the toilet 10. In the factory, a very accurate power source is used to furnish exactly 120 volts of alternating current to controllers 40 for North American use. For toilets that are to be used in European countries, a very accurate 240 volt power source is used. Therefore, at step 224, the microcomputer 42 reads the input value from the analog-to-digital converter 48 that designates the voltage that is supplied to the controller 40. This value corresponds to 120 or 240 volts and is stored at step 226 in the memory of the microcomputer 42 as the voltage reference value. The test routine then terminates by returning to step 76 of the main program depicted in FIG. 5A.

When a toilet 10 is installed in a building the control program bypasses the test routine and commences normal operation at step 76. There the microcomputer 42 determines whether a water level sensor error flag has been set, which indicates that a faulty water level sensor 44 was found during previous operation of the controller. If this flag is found to be set, an attempt is made to rectify the problem by the program branching to step 78 where the flush pump 22 is pulsed on and off for a brief error interval. The program has several fault branches during which the flush pump 22 is pulsed different numbers of times to provide an indication of the nature of the fault to a plumber servicing the toilet. For this fault condition, the pump is activated five times for 0.5 seconds each with one second between each activation, for example (Pattern 1). In addition, operating the flush pump in this manner should pump enough water from the tank 17 into the receptacle 12 to lower the water below the water level sensor 44, thus deactivating that switch. Therefore, after the flush pump 22 has shut off, the program execution waits for a brief period at step 80 to allow the switch to respond to the reduced water level. Then at step 82, a determination is made whether the water level sensor 44 is still producing an active signal which will occur if the fault condition still exists. In that case, the program execution branches to step 84 where it waits forever. Once the program enters a wait forever state, the only way to reset the toilet operation is to disconnect and reconnect the electrical power. However, if at step 82, the water level sensor 44 is found inactive, indicating that it responded to pumping water from the tank, the program execution advances to step 86 where the error flag is cleared. The program then returns to step 104 to commence normal operation of the toilet 10.

Returning for the moment to step 76, if at this juncture the water level sensor error flag was not found set, the program branches to step 88 where a determination is made whether a high water level flag was set as may have occurred during the previous operation of the toilet. The high water level flag indicates that the tank 17 was filled to an usually high level, probably because the float valve 58 malfunctioned, but that the water level sensor 44 did function properly. If this flag is set, the program execution branches to step 90 where the flag is cleared before advancing to step 92 at which the flush pump 22 is pulsed on and off. For this fault condition, the pump is activated three times for 0.5 seconds each with one second between each activation, for example (Pattern 2). This pump activation provides a different pulse pattern that occurs at step 78 to indicate a fault due to a high water level error. Then at step 94, the microcomputer 42 inspects the signal from the water level sensor 44. If the water level sensor is not active, indicating the switch responded to the reduction of the water level produced by flush pump activation, the program execution transfers to step 104 to commence normal operation. Otherwise, if the water level sensor 44 is still producing an active signal, which at this time erroneously indicates an excessively high level of water in the tank, the program continues to step 96 where the flush pump 22 is activated twice again for 0.5 seconds with one second there between (Pattern 3). This action further reduces the amount of water in the tank 17 before entering a continuous wait state at step 98. At this point, it has been determined that the water level sensor 44 is faulty and operation of the toilet is inhibited until corrective action is taken by the user. The controller remains in this wait state 98 until power is removed and the reapplied to the toilet 10.

If neither the switch error flag or the high water level flag is found set at steps 76 and 88, the microcomputer 42 checks the signal from the water level sensor 44 at step 100. If that switch is active the program branches to step 92, otherwise the execution continues to step 104.

Assuming that the toilet 10 is operating properly, the control program eventually reaches step 104 in FIG. 5A, at which the electrically operated tank fill valve 56 in FIG. 4 is opened to fill the tank 17 with the proper amount of water. Note that the electrically operated fill valve 56 is in series with a conventional mechanical float valve 58 which responds to the level of water in the tank 17. Thus, the controller 40 opens the fill valve 56 for predefined amount of time (e.g. 45 seconds) that normally is sufficient, even for relatively low water pressure within supply pipe 18, to fill the tank 17 completely. Upon opening the fill valve 56, the program advances to step 106 where the water level sensor 44 is monitored to ensure that the tank 17 does not overflow as it has an open top. Normally, the float valve 58 will shut off the flow of water into the tank before the level ever rises to the location of the water level sensor 44.

However, if that does not occur and the water level sensor 44 opens thereby producing an active signal, a transition occurs from step 106 to step 108. This results in the microcomputer 42 closing the fill valve 56 immediately to shut off the flow of water into the tank 17. The microcomputer 42 then sets the high water level flag at step 110. Next at step 112, the flush pump 22 is activated twice for 1.5 seconds with five seconds there between (Pattern 4) to reduce the water within the tank 17. Then the signal from the water level sensor 44 is inspected again at step 114 to determine whether it is still active. An active signal at this point indicates that the switch may be faulty as the water level has been reduced below the location of that switch. In this case, the program execution advances to step 115 where the high water level flag is reset and the switch error flag is set at step 116 before entering a forever wait state 118. However, if the pumping action deactivated the water level sensor 44 at step 114, the program execution continuously loops through that step without setting the level sensor error flag, while still inhibiting further operation of the toilet until the cause of the abnormally high water level has been identified.

Returning to step 106 from which the program advances to step 119 when the signal from the water level sensor 44 is not active, i.e. a normal water level exists in the tank 17. Now the value of a refill timer implemented by the microcomputer 42 is checked to determine if it has timed-out, i.e. reached zero. If this timer has expired, the tank fill valve 56 is closed at step 120, otherwise the program jumps around step 120 to step 122. This results in the value of flush lockout timer being compared to the value of a variable designated pump lockout to prevent the toilet 10 from being flushed too frequently which could overheat the motor of the flush pump 22. If the flush lockout timer has a value that is greater that the pump lockout value the toilet is inhibited from flushing the toilet again. In that case, the program returns to step 106 without checking the status of the flush switch 46 at step 124. When the pump may be flushed again, the status of the flush switch 46 is checked at step 124 and if it is not being pressed, the program execution returns to step 106. The program execution continues to loop through steps 106 and 119-124 until either the water level sensor 44 or the flush switch 46 is found to be active.

Figure 5B:
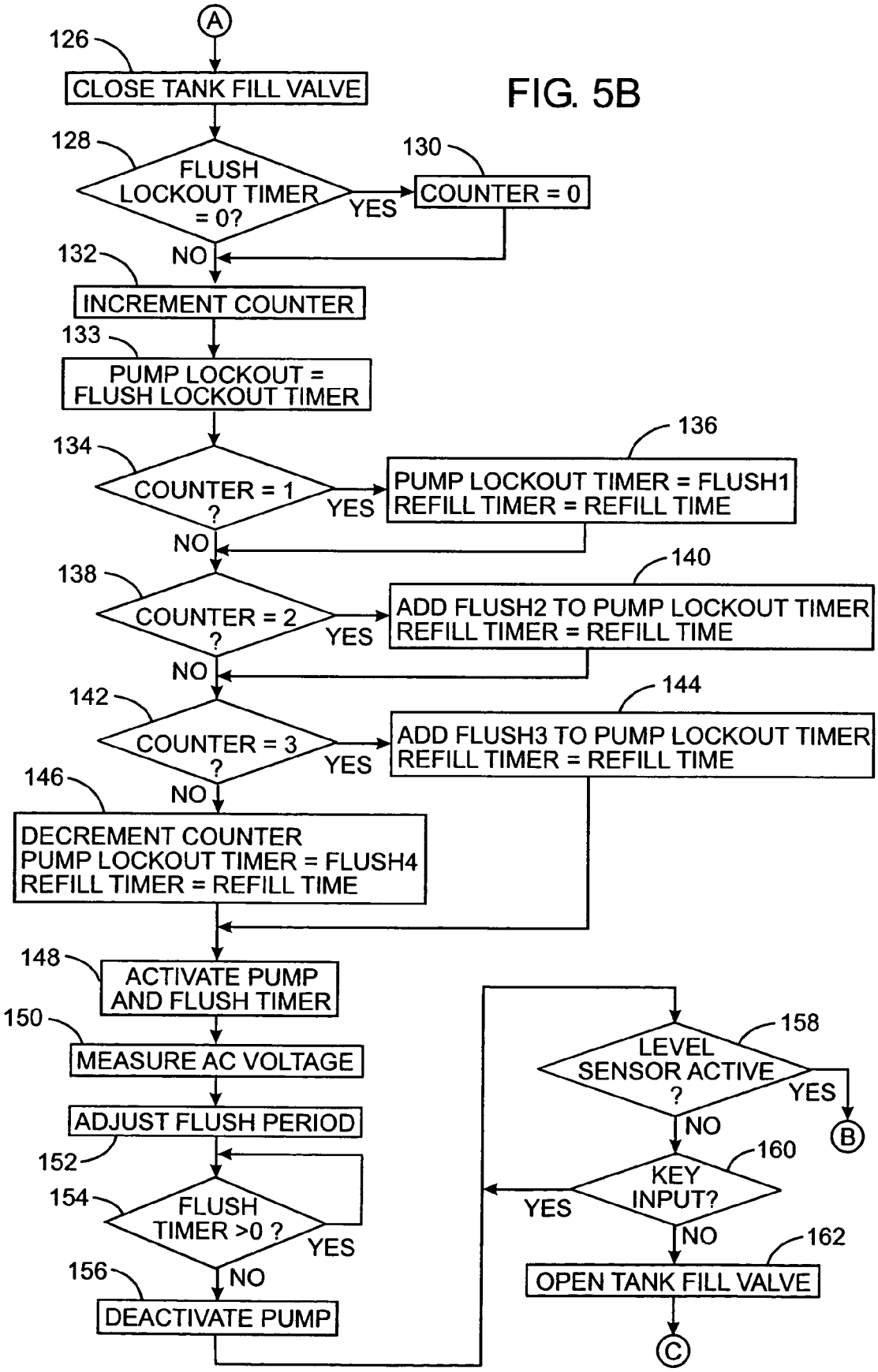

When the signal from the flush switch 46 indicates that the user desires to flush the toilet, the program execution branches to step 126 on FIG. 5B. At this time, the microcomputer 42 closes the tank fill valve 56. The value of the flush lockout timer is checked at step 128 and if it is zero a counter is initialized to zero at step 130. Regardless of the flush lockout timer value, the counter then is incremented by one at step 132. The counter indicates the number of times that the flush pump is activated before the flush lockout timer expires. Each successive activation, increases the flush lockout timer and the counter value. Before that happens however, the pump lockout variable is set to the present value of the flush lockout timer at step 133.

The program execution enters a section that increases the flush lockout timer based on how frequently the pump 22 has been activated. At step 134 the microcomputer 42 determines whether the value of the counter equals one, as occurs the first time the toilet is flushed after expiration of the lockout timer. For that counter value, the program branches to step 136 at which the flush lockout timer is set to a relatively short interval, designated Flush1. The refill timer also is initialized to the predefined refill time and started. The program then decides at step 138, whether the counter value equals two, as occurs after a subsequent flush operation, and if so an amount of time, designated Flush2, is added to the present value of the flush lockout timer at step 140. The refill timer is initialized again. Another check of the counter value is made at step 142 and when a value of three is found, an additional amount of time (Flush3) is added to the flush lockout timer at step 144. More than three counter iterations and flush lockout timer adjustments may be provided. When a counter value in excess of three exists the program reaches step 146 at which the counter is decremented and more time (Flush4) is added to the flush lockout timer. Each higher numbered additional flush time is greater than its predecessors to allow more motor cooling time with each successive flush. The flush pump 22 then is turned on at step 148.

At step 150, the program measures the level of the A/C supply voltage by reading the output of the analog-to-digital converter (ADC) 48. Preferably a plurality of measurements are taken over a period of time and averaged to provide a value representing the supply voltage. The speed at which the motor of the flush pump 22 operates is directly related to the magnitude of the supply voltage which is supplied to the toilet 10. The flush period is set at the factory with the toilet being powered by exactly the nominal supply line voltage (120 or 240 volts) for the country in which it is intended to be used. However, the supply line voltage at a particular installation of the toilet 10 may deviate significantly from that nominal voltage level, thereby affecting the speed of the flush pump 22 and the amount of water that is pumped into the toilet receptacle 12. For optimum water conservation, the amount of water used during each flush is maintained at the minimum level required to adequately remove waste from the toilet receptacle 12. If the flush pump 22 operates too slow, an insufficient amount of water may be pumped to remove the waste. Similarly, if the flush pump operates to fast, a greater amount of water that is necessary is consumed. As a consequence, at step 150, the supply voltage measurement is compared to the nominal voltage level that was stored in the microcomputer's memory during configuration at the factory. The difference between those voltage values is used at step 152 to access another look-up table within the memory of the microcomputer 42. This action provides a time increment by which to adjust the flush period in order to compensate for the effects of the supply voltage deviation. That is, for an actual supply voltage that is less then the nominal level, resulting in less water being pumped for a given interval of time, the flush period is increased by the time increment from the look-up table. For voltages in excess of the nominal level that result in faster pump operation, the flush period is decreased by the obtained time increment. The adjustment time increment read from the look-up table is combined with the previous flush period value to produce a new flush period value that is stored within the memory of the microcomputer 42 for subsequent use.

Then at step 154 the flush timer is continuously monitored and the flush pump is turned off at step 156 upon the timer expiring. Thereafter, at step 158 a determination is made whether the signal from the water level sensor 44 is active. If it is, the program jumps to step 108 to close the fill valve and take the remedial action at the subsequent steps described previously. Otherwise, the program progresses to step 160 to verify that the flush switch 46 is not stuck in the active, closed position. If that is the case, the program continues to loop through steps 158-160 until the problem is manually corrected. However, if the flush switch 46 is functioning properly, the program execution opens the tank fill valve at step 162 before looping back to step 106. At some point thereafter, when the refill timer found to have elapsed at step 119, the fill valve will be closed at step 120. The normal operation of the toilet 10 continues to loop through steps 106-162.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

The invention claimed is:

1. A plumbing fixture for receiving flushable waste comprising:

a receptacle for receiving the waste;

a tank for storing a volume of water;

an electrically operated pump having an inlet in communication with the interior of the tank and having a pump outlet coupled to the receptacle;

a sensor that produces a level signal when the water in the tank reaches a given level;

an input device operable by a user to produce a flush signal; and a controller connected to the sensor, the input device and the pump, wherein the controller responds to the level signal from the sensor by operating the pump to deliver water from the tank to the receptacle thereby preventing the tank from filling with an abnormally large amount of water, and responds to the flush signal by operating the pump for a predefined interval to deliver water from the tank to the receptacle, wherein the controller provides a high water level indication to a user in response to the level signal.

2. The plumbing fixture as recited in claim 1 further comprising a backflow check valve coupling the pump outlet to the receptacle to prevent a flow of water from the receptacle to the pump.

3. The plumbing fixture as recited in claim 1 further comprising a self priming check valve connected to the pump and in communication with the interior of the tank, wherein the self priming check valve enables air within the pump to escape and be replaced by water.

4. The plumbing fixture as recited in claim 1 wherein after operating the pump to deliver water from the tank to the receptacle in response to the level signal, the controller inhibits further operation of the plumbing fixture if the sensor continues to produce the level signal.

5. The plumbing fixture as recited in claim 4 wherein after the controller inhibits further operation of the plumbing fixture, such operation can be restored by a user resetting the controller.

6. The plumbing fixture as recited in claim 1 further comprising an electrically operated fill valve connected to the controller and controlling flow of water from a source into the tank.

7. The plumbing fixture as recited in claim 6 wherein controller responds to the level signal by inhibiting the fill valve from opening.

8. The plumbing fixture as recited in claim 6 wherein after operating the pump to deliver water from the tank to the receptacle in response to the level signal, the controller inhibits the fill valve from opening if the sensor continues to produce the level signal.

9. The plumbing fixture as recited in claim 6 further comprising a float operated valve in series with the electrically operated fill valve between the source and the tank; and wherein the controller opens the electrically operated fill valve for a given interval in response to an occurrence of the flush signal.

10. The plumbing fixture as recited in claim 1 wherein the controller responds to the level signal by cycling the pump on and off in a predefined pattern to provide the high water level indication to a user.

11. The plumbing fixture as recited in claim 1 wherein after operating the pump to deliver water from the tank to the receptacle in response to the level signal, the controller cycles the pump on and off in a predefined pattern to provide an error indication to a user if the sensor continues to produce the level signal.

12. A The plumbing fixture for receiving flushable waste comprising:

a receptacle for receiving the waste;

a tank for storing a volume of water;

an electrically operated pump having an inlet in communication with the interior of the tank and having a pump outlet coupled to the receptacle;

a sensor that produces a level signal when the water in the tank reaches a given level;

an input device operable by a user to produce a flush signal; and a controller connected to the sensor, the input device and the pump, wherein the controller responds to the level signal from the sensor by operating the pump to deliver water from the tank to the receptacle thereby preventing the tank from filling with an abnormally large amount of water, and responds to the flush signal by operating the pump for a predefined interval to deliver water from the tank to the receptacle, wherein the controller senses a magnitude of voltage supplied to the plumbing fixture and alters the predefined interval in response to variation of the voltage.

13. The plumbing fixture as recited in claim 12 wherein the predefined interval is altered by an amount that is determined in response to how much the magnitude of voltage that is sensed differs from a nominal voltage value.

14. The plumbing fixture as recited in claim 1 wherein the controller further determines how frequently the pump has been operated and inhibits reactivating the pump for a predetermined interval after operating the pump for the predefined interval, wherein the predetermined interval is increased in response to how frequently the pump has been operated.

15. A method for operating a plumbing fixture that includes a receptacle for receiving waste, a tank for storing a volume of water, a sensor that produces a level signal when the water in the tank reaches a given level, an input device operable by a user to produce a flush signal, an electrically operated pump having an inlet in communication with the interior of the tank and having a pump receptacle, and a controller connected to the sensor, the input device and the pump; said method comprising:

providing a high water level indication to a user in response to the level signal;

operating the pump to deliver water from the tank to the receptacle in response to the level signal from the sensor, thereby preventing an abnormally large amount of water from being stored in the tank; and operating the pump for a predefined interval to deliver water from the tank to the receptacle in response to the flush signal.

16. The method as recited in claim 15 further comprising after operating the pump to deliver water from the tank to the receptacle in response to the level signal, inhibiting further operation of the plumbing fixture if the sensor continues to produce the level signal.

17. The method as recited in claim 16 further comprising after inhibiting further operation of the plumbing fixture, restoring operation of the plumbing fixture can be in response to a user performing a reset operation.

18. The method as recited in claim 15 further comprising operating an electrically activated fill valve to control flow of water from a source into the tank.

19. The method as recited in claim 18 further comprising after operating the pump to deliver water from the tank to the receptacle in response to the level signal, inhibiting the fill valve from opening if the sensor continues to produce the level signal.

20. The method as recited in claim 15 wherein providing a high water level indication comprises cycling the pump on and off in a predefined pattern in response to the level signal.

21. The method as recited in claim 15 further comprising after operating the pump to deliver water from the tank to the receptacle in response to the level signal, cycling the pump on and off in a predefined pattern to provide an error indication to a user if the sensor continues to produce the level signal.

22. The method as recited in claim 15 further comprising:

cycling the pump on and off in a first predefined pattern in response to the level signal to provide an high water level indication to a user; and after operating the pump to deliver water from the tank to the receptacle in response to the level signal, cycling the pump on and off in a second predefined pattern to provide an an error indication to a user if the sensor continues to produce the level signal.

* * * * *